United States Patent [19]

Tatt et al.

[11] Patent Number: 4,657,783

[45] Date of Patent: Apr. 14, 1987

[54] PROCESS AND APPARATUS FOR COATING PAPER

[75] Inventors: Christopher F. Tatt, Bonvilston, Near Cowbridge, Wales; Kenneth Richards, Ascot; Michael R. Chamberlain, Hazlemere, both of England

[73] Assignee: The Wiggins Teape Group Limited, Basingstoke, England

[21] Appl. No.: 694,783

[22] Filed: Jan. 25, 1985

[30] Foreign Application Priority Data

Jan. 27, 1984 [GB] United Kingdom ..... 8402190

[51] Int. Cl.[4] ..... B05D 1/28

[52] U.S. Cl. ..... 427/211; 118/206; 118/227; 118/228; 118/244; 118/261; 427/152; 427/366; 427/369; 427/391; 427/395

[58] Field of Search ..... 118/206, 244, 261, 227, 118/228; 427/211, 366, 369, 152, 395, 391

[56] References Cited

U.S. PATENT DOCUMENTS

| | | | |
|---|---|---|---|
| 2,325,798 | 8/1943 | Porter | 427/206 |
| 2,670,564 | 2/1961 | Warner | 118/227 |
| 2,676,563 | 4/1954 | Montgomery et al. | 118/227 |
| 3,293,067 | 12/1966 | Streb et al. | 118/206 |
| 3,908,042 | 9/1975 | Hussler et al. | 118/228 |
| 4,198,446 | 4/1980 | Goetz | 427/150 |
| 4,354,449 | 10/1982 | Zink | 118/126 |
| 4,357,370 | 11/1982 | Alherd | 118/206 |

FOREIGN PATENT DOCUMENTS

| | | |
|---|---|---|
| 1404616 | 9/1975 | United Kingdom . |
| 1419316 | 12/1975 | United Kingdom . |

*Primary Examiner*—Norman Morgenstern
*Assistant Examiner*—Janyce A. Bell
*Attorney, Agent, or Firm*—Burns, Doane, Swecker & Mathis

[57] ABSTRACT

A process for effecting the high speed coating (as herein defined) of both sides of a lightweight paper sheet (as herein defined) with coatings of low dry coatweight (as herein defined), while maintaining good coating pattern and control over the degree of curl in the sheet when dried, comprising the steps of:

moving an endless transfer surface sequentially through first, second and third stations, at first station, forming on said transfer surface a smooth continuous film of a first coating mix having a predetermined fluid content and rheology, at the second station, bringing a first side of said paper sheet into contact with said transfer surface and simultaneously subjecting the sheet to pressure against said transfer surface without substantial sheet distortion, so as to promote substantially complete absorption by the sheet of the solvent or dispersion medium of the first coating mix while in engagement with the transfer surface and prior to passage of the sheet and transfer surface through the third station.

at the third station, applying to the second side of the sheet a second coating mix having a predetermined fluid content and rheology optionally differing from that of the first coating mix, and separating the sheet from the transfer surface for drying.

12 Claims, 5 Drawing Figures

PROCESS AND APPARATUS FOR COATING PAPER

Figure 1:
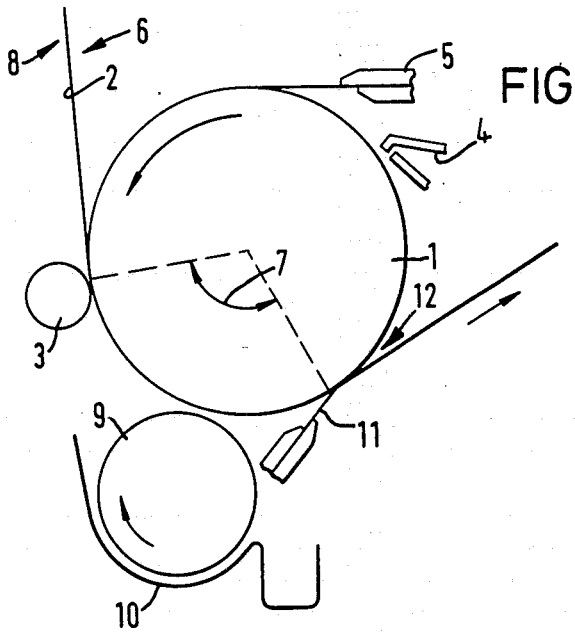

This invention relates to a process and apparatus for coating both sides of a paper sheet, and finds particular applicability in the manufacture of carbonless copying paper.

In particular, the invention is concerned with a process and apparatus for the high speed coating of both sides of a lightweight paper sheet with coatings of low dry coatweight whilst maintaining good coating patterns and substantially independent control of the dry coatweights and water loads applied to the two sides of the sheet. This ensures that good hygrostability and flatness is achieved in the dried coated sheet whilst maintaining the required functional properties of the coatings.

In this specification, high speed is to be taken as meaning speeds of in the region of 600 meters per minute or higher.

A light weight paper sheet is to be taken as meaning a sheet of about 70 grams meter$^{-2}$ or less or a caliper or thickness of about 120 microns or less. The process and apparatus of the invention are of especial value in the coating of paper sheet of 50 grams meter$^{-2}$ or less, for example in the region of 30 grams meter$^{-2}$.

A coating of low coatweight is to be taken as referring to a dry coatweight of about 10 grams meter$^{-2}$ or less. The process and apparatus of the invention are of especial value in the formation of very low dry coatweights of in the region of 0.1 grams meter$^{-2}$.

Conventionally, two sided coating has been achieved by coating and drying each side of the sheet in sequence. However, two separate drying systems are required for this purpose, leading to high capital and energy costs.

Coating techniques have therefore been evolved for applying coatings to both sides of the sheet before drying is effected. In one such arrangement, the two coatings are applied to opposite sides of the sheet in sequence at separate coating stations and the sheet then passed through a drying station. The disadvantage of this arrangement, especially in the coating of lightweight papers, lies in the fact that the moisture introduced into the paper at the first station causes it to expand and therefore extend in length. As a result, slack develops between the first and second coating stations which must be taken up by increasing the speed at which the sheet is drawn from the first station. But the amount of expansion which the paper undergoes cannot be reliably measured and permit the take up of slack to be precisely catered for in the paper drive mechanism. Consequently the wet paper is unavoidably and intermittently subjected to excessive tension and becomes distorted, or the dried paper may contain stresses which cause it to distort when subjected to changes in humidity.

Other known arrangements avoid this distortion problem by coating both sides of the paper substantially simultaneously.

Thus in one arrangement the paper is passed upwardly between two opposed applicator rolls, which apply coatings to both surfaces, and then between opposed trailing blades, which meter and smooth the coatings. Such an arrangement can only readily be used to apply identical coatweights to the two surfaces since the use of opposed blades results unavoidably in balanced hydrodynamic pressures. In addition, since the inevitable breaks which occur in the coating of paper will cause mixing of the coating mixes being applied, such coating configurations are in practice only of use where the same mix is being applied to each side of the paper.

Another arrangement includes a roll coating system having an applicator roll which generally runs at a higher surface speed than the paper sheet and which engages on one side of the sheet as it is drawn downwardly past the roll. The other side of the paper is coated by means of a trailing blade which bears against the paper whilst it is in contact with the applicator roll, with a pond of coating mix being maintained above the blade. The blade and applicator roll thus form a "nip" through which the paper passes.

Whilst this configuration is acceptable for many coating applications, it gives unsatisfactory results in certain circumstances.

First, the coatings to be applied to the two sides of the paper sometimes consist of dispersions or solutions of very different rheology. In addition, the solids content and, in consequence, the content of the dispersion medium or solvent (which is usually, but is not necessarily water) in the two coating mixes may differ substantially. Furthermore, because the same pressure in unavoidably applied to both sides of the paper at the blade to applicator roll "nip" it is not possible to control the coatweight being applied to one side independently of that being applied to the other side. Consequently, unless the water contents of the two mixes are initially very similar, difficulties are sometimes encountered with such an arrangement in attempting to control the water loads being applied to the two paper surfaces as components of the mixes. If the water loads differ excessively, the two sides of the paper dry at different rates during the drying process and the finished paper develops a distinct and uncontrolled curl.

The curl problem can also be aggravated by differential contraction of the solids contents of the mixes during drying. Such curl is generally adjusted by subjection to one of a number of different moisturization techniques during the drying process. But the stresses produced by the coatings remain and can affect the subsequent behavior of the paper even if it is flat after drying, for example in response to humidity changes or wet offset printing.

Secondly, and in order to increase productivity, it is desirable to be able to run the coating system at speeds in excess of 600 meters per minute. But it has been found that at such speeds a very high hydrodynamic mix pressure develops under the blade, and considerable turbulence is generated in the pond of coating mix maintained above it. These two phenomena together give rise to an uneven and unacceptable distribution of the wet coating on the paper surface and hence to non uniform coatings in the dried sheet.

Thirdly, and where the roll coater component of the assembly is of a conventional form and is used for the application of a material at low solids and low viscosity, for example surface sizing, film splitting has been found to occur with a consequent deleterious effect on coating pattern and the flatness of the dried sheet.

It is among the objects of the present invention to provide an improved coating process and apparatus which will substantially alleviate the foregoing problems.

The invention therefore provides a process for effecting the high speed coating (as herein defined) of both sides of a lightweight paper sheet (as herein defined) with coatings of low dry coatweight (as herein defined), whilst maintaining good coating pattern and control over the degree of curl in the sheet when dried, comprising the steps of:

moving an endless transfer surface sequentially through first, second and third stations, at the first station, forming on said transfer surface a smooth continuous film of a first coating mix having a predetermined fluid content and rheology, at the second station, bringing a first side of said paper sheet into contact with said transfer surface and simultaneously subjecting the sheet to pressure against said transfer surface without substantial sheet distortion, so as to promote substantially complete absorption by the sheet of the solvent or dispersion medium of the first coating mix whilst in engagement with the transfer surface and prior to passage of the sheet and transfer surface through the third station.

at the third station, applying to the second side of the sheet a second coating mix having a predetermined fluid content and rheology optionally differing from that of the first coating mix, and separating the sheet from the transfer surface for drying.

By providing for the fluid content of the first coating to be absorbed by the sheet and at the same time ensuring that the sheet is engaged with the transfer surface between the second and third stations, no fluid layer is present on the first side of the sheet when the second coating is applied.

This in effect ensures that the first and second coating procedures are independent of each other and facilitates precise control of the water loadings being applied.

At the same time, because the fluid content of the first coating is fully absorbed into the sheet, no film remains on the first side of the sheet to cause the development of a film split pattern when the sheet is separated from the transfer surface.

The fluid or water loadings applied to the two surfaces of the sheet are controlled as required so as to affect the resultant curl. Thus the sheet, when dried, may be flat and present no curl, or a certain degree of curl can be provided in contemplation of a further coating step on one side of the paper which will rectify the curl and produce a flat sheet.

For example in the manufacture of CFB grade carbonless copying paper having a coating of reactive clay on the front and of microcapsules on the back, the process of the invention may be used to apply a microcapsular mix as the first coating and the reactive clay as the second coating. If the microcapsular mix is applied at a wet coatweight of 20 grams meter$^{-2}$ comprised of 15 grams of water and 5 grams of microcapsules binder and capsule protection agent and the reactive clay mix at a wet coatweight of 16.0 grams meter$^{-2}$ comprised of 8 grams of water and 8 grams of clay and binders, a substantially flat sheet results when dried. The differences in the water loadings on the two sides of the sheet take account of the tendency of the two coatings to contract differently during drying and offset the higher water loading applied with the microcapsules.

In the manufacture of CF grade carbonless copying paper however, the microcapsular coating is omitted. It is therefore necessary to treat the first side of the paper so as to correct for any tendency for the paper to curl towards the clay coated side, and in certain circumstances it is desirable to generate curl away from the clay coated side. This curl correction can, for example be effected in the method of the invention by applying, as the first coating, a sizing material at a wet coatweight of 15 grams meter$^{-2}$ consisting of 14.8 grams of water and 0.2 grams of starch. This produces a desired degree of curl away from the clay coated surface upon drying.

In another aspect, the invention provides apparatus for forming a low coatweight coating (as hereinbefore defined) on each side of a lightweight paper sheet (as hereinbefore defined), whilst predetermining the degree of curl in the sheet when dried, comprising a backing roll for supportive engagement with a first side of a paper sheet and transferring thereto a film of a coating mix, means for forming a continuous film of the first coating mix on said backing roll, a trailing blade metering device for metering and smoothing the film on the backing roll, a pressure roll forming a nip with the backing roll, the pressure and backing rolls being adapted to apply a nip pressure of at least 0.5 kilograms per centimeter transversely of the sheet so as to conform the sheet, without substantial distortion, to the profile of the backing roll as to promote absorption by the paper sheet of the fluid content of the film, and means for applying a coating of a second coating mix to the second side of the sheet after the fluid content of the film has been absorbed.

Preferably the pressure roll is softer than the backing roll. However this need not necessarily be the case. It is only necessary that the specified nip pressure be maintained without substantial deformation of the sheet from the circumferential profile of the backing roll by indentation of the backing roll at the nip.

The means for applying the first and second coating mixes to the applicator roll and second side of the paper may comprise gate or applicator rolls, but, in order to minimize coating pattern, preferably consist of fountain applicators. The metering means in both cases are preferably bent or soft blade configurations, of which the flexible blade configuration sold under the trade name "S-Matic" by Beloit Corporation is especially preferred. The use of a trailing blade is essential where the mix to be applied to the applicator roll consists of a low solids low viscosity starch size since such an arrangement has been found to alleviate the film splitting pattern problem which otherwise occurs. Where appropriate to the materials being coated however, metering rolls may be used in substitution for trailing blades.

The invention will now be further described with reference to the accompanying drawings, in which FIGS. 1, 2, 3, 4 and 5 are diagrammatic side elevations of five embodiments of coating device according to the invention.

Referring to FIG. 1, the device shown comprises a backing roll 1 around which a paper sheet 2 is led for coating. The sheet 2 is brought and held in close engagement with the roll 1 by a pressure roll 3 which is softer than the backing roll. Coating mix is deposited on the surface of the roll 1 by means of a fountain applicator shown at 4 downstream of which is a metering blade 5, which may be example, be a S-Matic flexible blade as manufactured by Beloit Corporation. The coating thus metered onto the roll 1 is applied by the backing roll to the first side 6 of the sheet so that the water content is progressively absorbed by the sheet whilst in contact with the roll along the arc 7.

The use of the S-Matic blade as the blade 5 when coating a low solids low viscosity starch size on the side 6 of the paper has been found to alleviate film splitting at the point 12 as the paper separates from the backing roll.

The second coating is applied to the second side 8 of the paper sheet by means of an applicator roll 9 which is supplied with the coating mix from a trough 10. A second metering blade 11 meters the coating applied to the side 8 of the sheet by the applicator roll 9.

Figure 2:
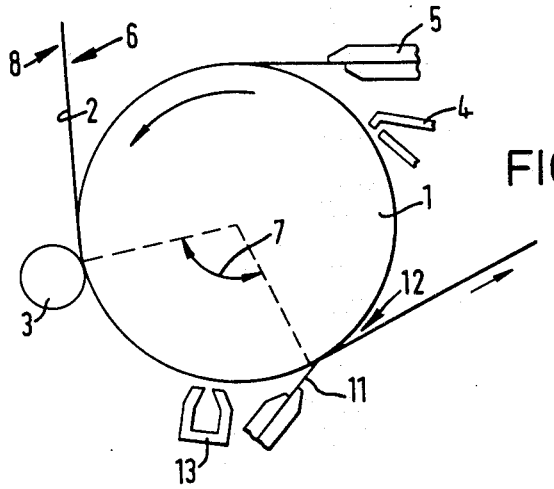
Figure 3:
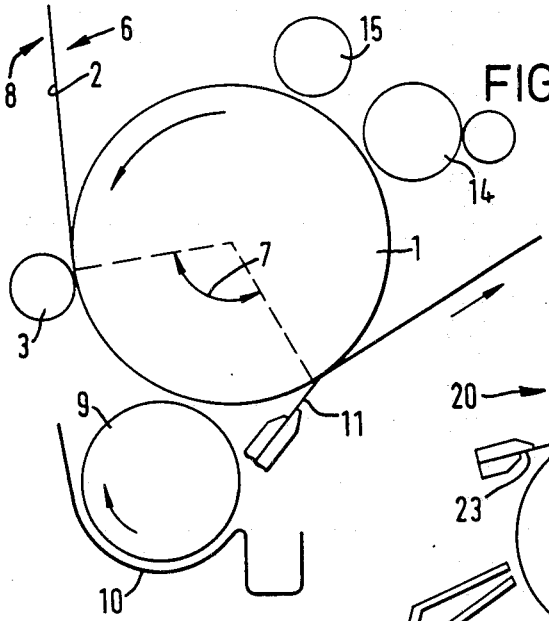
Figure 4:
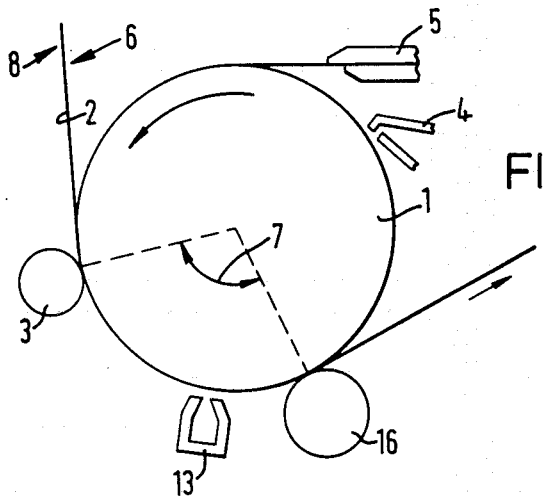

In FIGS. 2, 3 and 4, components already described with reference to FIG. 1 are assigned the same reference numerals and will not be further described.

Turning now to FIG. 2, the coating device there shown is substantially the same as that shown in FIG. 1 except for the replacement of the applicator roll 9 and the trough 10 by a second fountain applicator 13 which applies the second coating mix to the side 8 of the paper.

FIGS. 3 and 4 show further variance on the arrangement shown in FIG. 1. Thus in FIG. 3, the fountain applicator 4 and metering blade 5 ar replaced by a gate roll applicator 14 and a metering roll 15. In FIG. 4, the blade 11 is replaced by a metering roll 16. It will be evident that the various components can be assembled in other configurations so as to achieve the same objectives.

It has been found that with the use of coating assemblies of the kind described in FIGS. 1 to 4, speeds of up to 1000 meters per minute can be achieved whilst maintaining satisfactory coating pattern. Where the two mixes to be applied are of dissimilar theology and water content the coatweights applied can be independently controlled so as to substantially predetermine the water load applied to the two sides of the paper without detriment to the resulting coatings, thus enabling the degree of residual curl in the dried paper to be controlled to a desired level.

Figure 5:
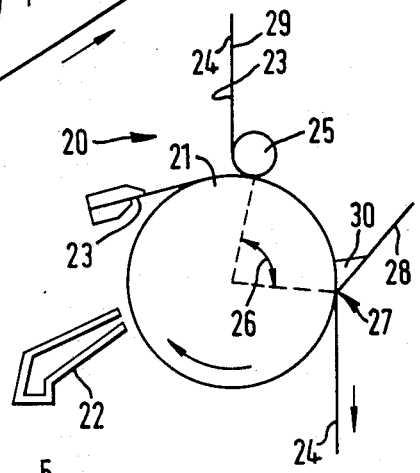

The coating device of FIG. 5 is a modification of the known configuration of an applicator roll and a trailing blade, which partially overcomes the disadvantages of such a configuration as hereinbefore described.

The device 20 of FIG. 5 comprises an applicator roll 21 to which coating mix is applied by means of a fountain applicator 22 and smoothed by a trailing blade, which may for example, be an S-Matic flexible blade 23 of the kind hereinbefore referred to. The paper 24 to be coated is led around a hard press roll 25 so as to bring its surface into engagement with the applicator roll 21, after which it maintains contact with the roll around an arc 26 so as to promote absorbence of the liquid content of the coating mix by the paper. At the point 27, a trailing blade 28 bears on the other surface 29 of the paper so as to maintain a pool 30 of a second coating mix above the blade.

Because the water content of the first coating mix has been substantially absorbed by the paper before the second coating mix is applied, variations in coatweight can be achieved as between the coatings being applied to the two sides of the paper. As a result, the configuration of FIG. 5 can assist in equalizing of the water loads being applied, so that curl in the paper can be reduced or obviated.

In all of the foregoing embodiments, the use of a trailing flexible blade has been proposed for metering and smoothing the film applied to the backing roll. Such metering and smoothing of low solids low viscosity thin films may however be effected by a roller blade system such as that sold under the trade name Vari-bar by Jagenberg G.m.b.H. It is also possible where space permits, to smooth and meter such coatings by gravure systems such as those described in U.S. Pat. No. 4,198,446 or UK Pat. No. 1404616.

The second coating mix may alternatively be applied by means of the short dwell time blade coater described in U.S. Pat. No. 4,357,370. This coater configuration minimizes the time between mix application and metering and reduces still further the risk of interaction between the first and second coatings.

The process and apparatus also facilitates the application of tinted coatings at the size press position on the paper machine to produce tinted grades of satisfactory quality. This obviates the need for tinting the furnish at or before the headbox and substantially reduces the downtime on the paper machine required in washing down between the making of different tinted grades.

We claim:

1. A process for effecting the high speed coating of both sides of a lightweight paper sheet with coating of low dry coatweight, whilst maintaining good coating pattern and control over the degree of curl in the sheet when dried, comprising the steps of:

moving an endless transfer surface sequentially through first, second and third stations, at the first station, forming on said transfer surface a smooth continuous film of a first coating mix having a predetermined fluid content and rheology, at the second station, bringing a first side of said paper sheet into contact with said transfer surface and simultaneously subjecting the sheet to pressure of about 0.5 kilograms per linear centimeter with a pressure roll which is softer than said transfer surface without substantial sheet distortion, so as to promote substantially complete absorption by the sheet of the fluid content of the first coating mix whilst in engagement with the transfer surface and prior to passage of the sheet and transfer surface through the third station, at the third station, applying to the second side of the sheet a second coating mix having a predetermined fluid content and rheology, and separating the sheet from the transfer surface for drying.

2. Apparatus for forming a low coatweight coating on each side of a lightweight paper sheet whilst predetermining the degree of curl in the sheet when dried, comprising a backing roll for supportive engagement with a first side of a paper sheet and transferring thereto a film coating mix, means for forming a continuous film of the first coating mix on said backing roll, a trailing blade metering device for metering and smoothing the film on the backing roll, a pressure roll forming a nip with the backing roll, the pressure roll having a softer surface than the backing roll, the pressure and backing rolls being adapted to apply a nip pressure of about 0.5 kilograms per linear centimeter transversely of the sheet so as to conform the sheet, without substantial distortion, to the profile of the backing roll and so as to promote absorption by the paper sheet of the fluid content of the film, and means for applying a coating of a second coating mix to the second side of the sheet while the sheet engages the backing roll after the fluid content of the film has been absorbed, the means for applying the coating being spaced from the pressure roll.

3. A process for effecting the high speed coating of both sides of a lightweight paper sheet as claimed in claim 1 in which the fluid content and rheology of the second coating mix differ from that of the first coating mix.

4. Apparatus as claimed in claim 2 in which the means for applying the first and second coating mixes to the applicator roll and the second side of the paper comprise gate or applicator rolls.

5. Apparatus as claimed in claim 2 in which the means for applying the first and second coating mixes to the applicator roll and the second side of the paper comprise fountain applicators.

6. Apparatus as claimed in claim 4 in which the metering means are bent, soft or flexible blade configurations.

7. Apparatus as claimed in claim 6 in which a trailing blade is utilized.

8. Apparatus as claimed in claim 2 in which the metering means include metering rolls.

9. Apparatus as claimed in claim 2 in which the metering means include metering rolls.

10. Apparatus as claimed in claim 5 in which the metering means are bent, soft or flexible blade configurations.

11. Apparatus as claimed in claim 2 in which the means for applying the first and second coating mixes to the applicator roll and the second side of the paper comprise gate or applicator rolls.

12. Apparatus as claimed in claim 2 in which the means for applying the first and second coating mixes to the applicator roll and the second side of the paper comprise fountain applicators.

* * * * *